US005203403A

United States Patent [19]

Yokoyama et al.

[11] Patent Number: 5,203,403

[45] Date of Patent: Apr. 20, 1993

[54] FIN-TUBE HEAT EXCHANGER

[75] Inventors: Shoichi Yokoyama, Otsu; Hitoshi Motegi, Kusatsu; Toshiaki Andoh, Otsu, all of Japan

[73] Assignee: Matsushita Electric Industrial Co., Ltd., Osaka, Japan

[21] Appl. No.: 835,686

[22] Filed: Feb. 14, 1992

[30] Foreign Application Priority Data

Feb. 21, 1991 [JP] Japan ..... 3-026596

[51] Int. Cl.[5] ..... F28F 1/32

[52] U.S. Cl. ..... 165/151; 165/182

[58] Field of Search ..... 165/151, 182

[56] References Cited

FOREIGN PATENT DOCUMENTS 59-210296 11/1984 Japan ..... 165/151

2-29597 1/1990 Japan ..... 165/151

*Primary Examiner*—Allen J. Flanigan

*Attorney, Agent, or Firm*—Stevens, Davis, Miller & Mosher

[57] ABSTRACT

A plate fin heat exchanger has a group of fins arranged at predetermined intervals so that an air current flows between the respective fins and a group of tubes respectively inserted into and joined to the cylindrical fin collars which are formed in the fin group with a predetermined longitudinal pitch and lateral pitch. Elliptical seats each having a longitudinally extending short axis are respectively provided around the fin collars on the surface of each of the fins, and seat-side ridge portions are respectively formed along the outer peripheries of the seats. A plurality of fin-side ridge portions, each having a longitudinally linearly extending ridge and substantially the same height as that of each of the seat-side ridge portions, are formed in each line of the fin collars outside the seat-side ridge portions on each of the fins. The turbulence promoting effect of the fin-side ridge portions, each having a longitudinally linearly extending ridge, improves the heat transfer efficiency. In addition, the highest portions of the seat-side ridge portions formed between the fin-side ridge portions cause the air current to be controlled by the wake in the tubes so as to decrease the stagnation region, thereby increasing the heat transfer effective area and improving the heat transfer efficiency.

4 Claims, 8 Drawing Sheets

FIN-TUBE HEAT EXCHANGER

BACKGROUND OF THE INVENTION

1. FIELD OF THE INVENTION

The present invention relates to a fin-tube heat exchanger which can be used for a heat pump type air conditioner using air as a heat source and, particularly, which can also be used outdoors.

2. DESCRIPTION OF RELATED ART

A conventional fin-tube heat exchanger is described below with reference to FIGS. 1, 2 and 3.

As shown in FIG. 1, a fin-tube heat exchanger generally comprises a group of fins 2 (2A, 2B) which are arranged in parallel at predetermined intervals so that an air current 1 flows between the respective fins 2, cylindrical fin collars 3 (3A, 3B) which are formed in the fin group 2 with a predetermined longitudinal pitch and lateral pitch, and a group of tubes 4 which are respectively inserted into the fin collars 3 and then joined to the fin collars 3.

The fin 2A of a first example of conventional fin-tube heat exchangers shown in FIGS. 2 and 3 has circular seat portions 6 respectively provided concentrically with the fin collars 3A on the surface of the fin 2A, and a plurality of ridge portions 7 which are formed in each line of the fin collars 3A outside the fin collars 3A of the seat portion 6, and each of which has a ridge linearly extending in the longitudinal direction of the fin 2A. When the air current 1 flows between the respective fins 2A, heat transfer can thus be promoted due to the turbulence promoting effect.

The fin 2B of a second example of conventional fin-tube heat exchangers shown in FIGS. 4 and 5 has a plurality of raised portions 8 which are provided between the adjacent two fin collars 3B on the surface of the fin 2B in the longitudinal direction thereof, whereby heat transfer can be promoted by the boundary layer leading-edge effect when the air current 1 flows between the respective fins 2B.

However, when a heat exchanger which uses the fin 2B shown in FIGS. 4 and 5 is used outdoors for a heat-pump air conditioner and is operated for heating, if the outside air temperature is decreased, frost adheres to the leading edges of the raised portions having a high efficiency of heat transfer, and the leading edges of the raised portions are closed after a while. The heat exchanger thus has the problem that the heat transfer efficiency is abruptly decreased, and the heat exchanger cannot be continuously operated over heating for a long time period.

When a heat exchanger having the fins 2A shown in FIGS. 2 and 3 is used outdoors for a heat pump-type air conditioner and operated for heating, since the fins 2A have no raised portion, even if the outside air temperature is decreased, the exchanger can be continuously operated for heating over a longer time, than the heat exchanger having the fins 2B shown in FIGS. 4 and 5. However, the heat exchanger has the problems that (1) because heat transfer is promoted by the turbulence promoting effect, the heat transfer efficiency is not so high, as compared with the heat exchanger having the fins 2B shown in FIGS. 4 and 5 in which heat transfer is promoted by the boundary layer leading edge effect, and (2) it is impossible to significantly enhance the performance of a heat pump-type air conditioner and decrease the size thereof.

SUMMARY OF THE INVENTION

A fin-tube heat exchanger of the present invention has a high heat transfer efficiency and can be continuously operated for heating over a long period of time, even if it is used outdoors for a heat pump type air conditioner.

Namely, the fin-tube heat exchanger of the present invention comprises a group of fins which are arranged in parallel at predetermined intervals so that an air current flows between the respective fins and a group of tubes which are respectively inserted into cylindrical fin collars formed in the fin group with a predetermined longitudinal pitch and lateral pitch and which are then respectively joined to the fin collars so that a fluid flows therethrough. Seats, each having a shape which decreases the ventilation resistance and which has a long axis and a short axis, are respectively provided around the fin collars on the surface of each of the fins, and seat-side ridge portions are respectively formed along the outer peripheries of the seats. A plurality of fin-side ridge portions each having a ridge linearly extending in the longitudinal direction of the fins and having substantially the same height as that of the highest portion of each of the seat-side ridge portions are formed in each line of the fin collars outside the seat-side ridge portions on each of the fins. The highest portions of the seat-side ridge portions are formed between the tops of two fin-side ridge portions, and ridge portions each having the same height as that of the highest portion of each of the seat-side ridge portions are respectively formed on the leeward sides of the fin-side ridge portions. Seat-side ridge portions each having substantially the same height as that of the top of each of the fin-side ridge portions are respectively formed along the peripheries of the fin collars.

In the above-described construction, the fin-side ridge portions each having a longitudinally linearly extending ridge have a turbulence promoting effect which improves the heat transfer efficiency, and the seat-side ridge portions respectively formed in the outer peripheries of the seats cause the air current to be controlled by the wake in the tubes so as to decrease the stagnation region, thereby increasing the heat transfer effective area and improving the heat transfer efficiency.

In addition, since ridge portions each having the same height as that of the top of each of the seat-side ridge portions are respectively formed on the leeward sides of the fin-side ridge portions, the air current is more easily controlled by the wake in the tubes so as to further increase the dead water region. This decreases the heat transfer effective area and improves the heat transfer efficiency. Further, since the seat-side ridge portions each having substantially the same height as that of the top of each of the fin-side ridge portions are respectively formed over the whole peripheries of the seats, the heat transfer of the portions near the tubes is accelerated due to the occurrence of vortexes. The seats, each having a shape which suppresses any increase in the ventilation resistance smooth the ventilation.

DESCRIPTION OF PREFERRED EMBODIMENTS

Figure 1:
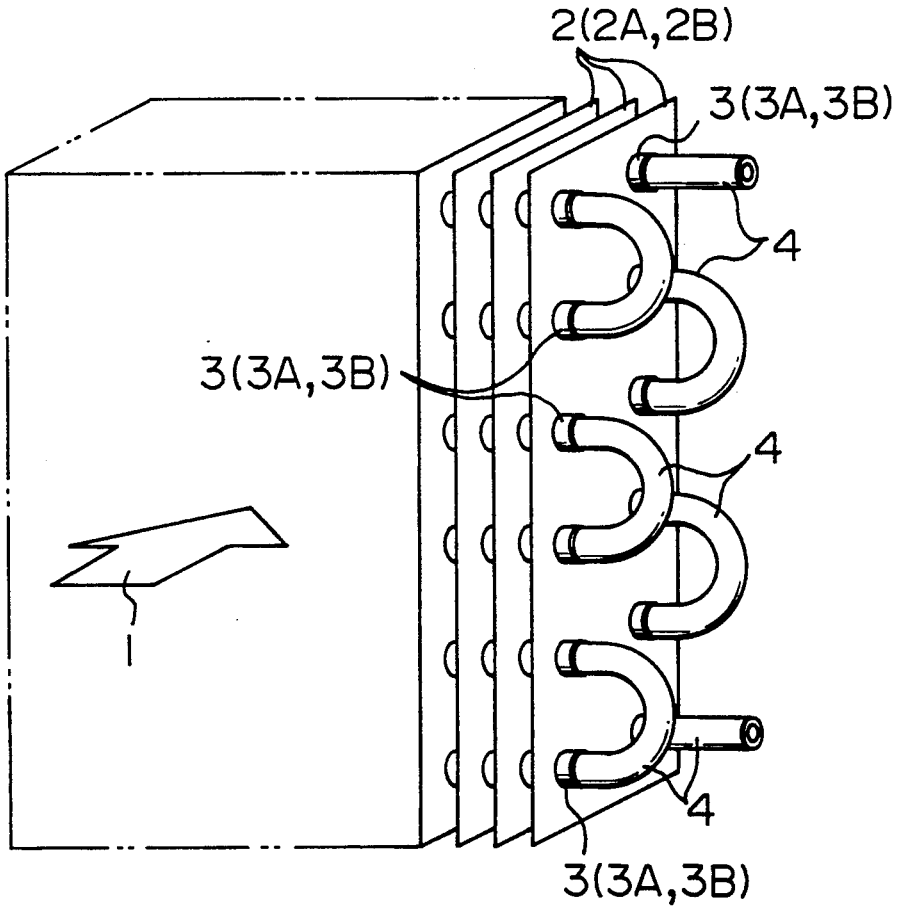
FIG. 1 PRIOR ART
FIG. 1 is a perspective view of a general fin-tube heat exchanger.
Figure 2:
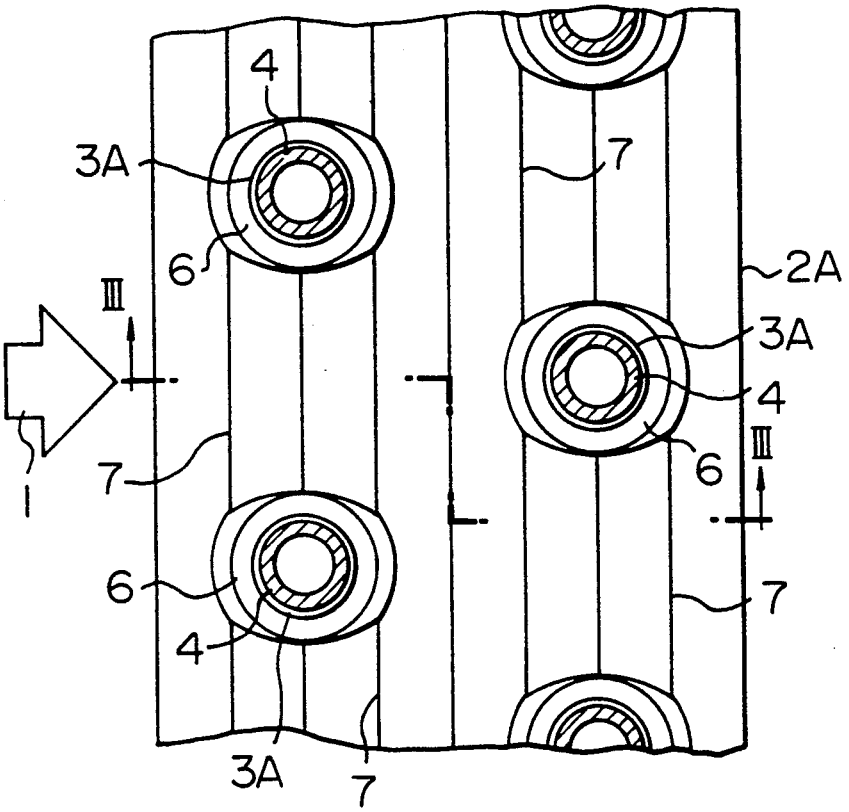
FIG. 2 PRIOR ART
FIG. 2 is a front view of a fin of a first example of conventional fin-tube heat exchangers.
Figure 3:
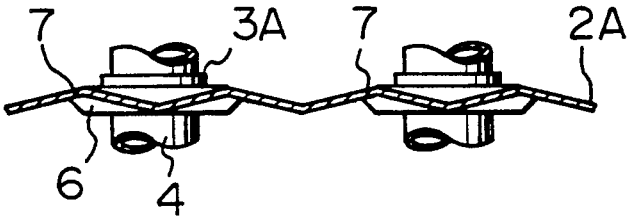
FIG. 3 PRIOR ART
FIG. 3 is a sectional view taken along the line III—III in FIG. 2.
Figure 4:
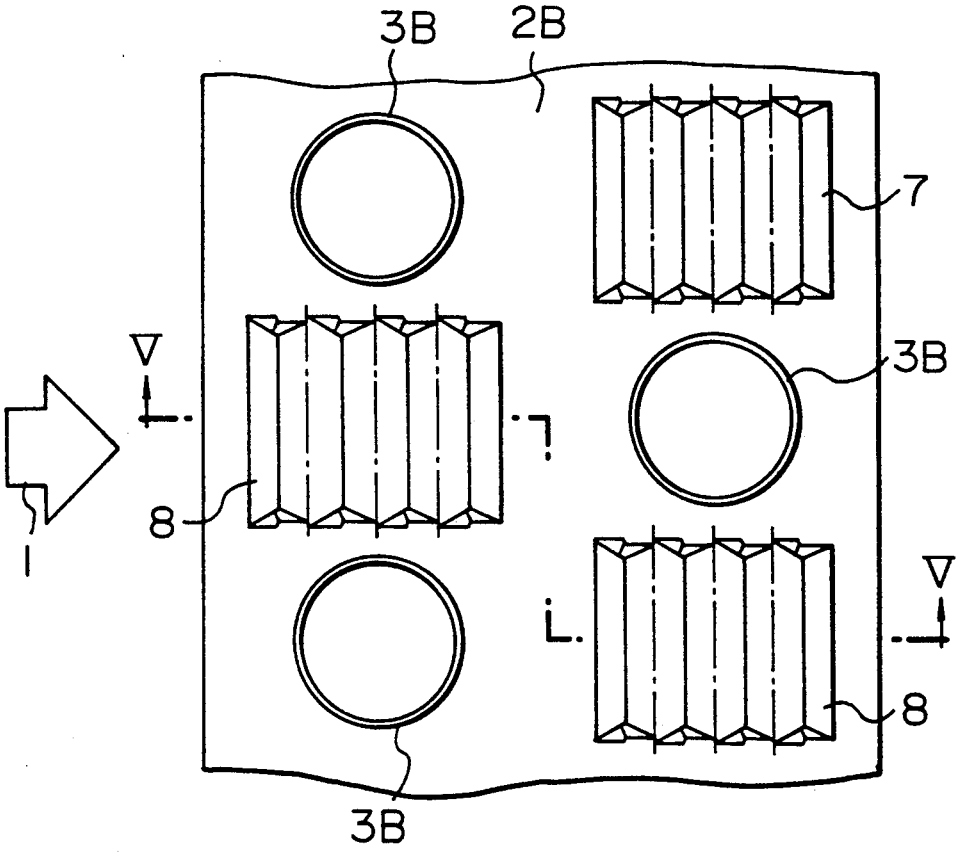
FIG. 4 PRIOR ART
FIG. 4 is a front view of a fin of a second example of conventional fin-tube heat exchangers.
Figure 5:
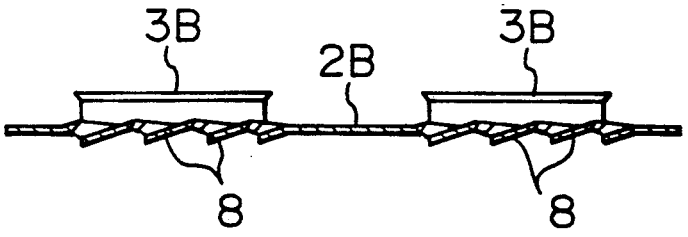
FIG. 5 PRIOR ART
FIG. 5 is a sectional view taken along the line V—V in FIG. 4.
Figure 6:
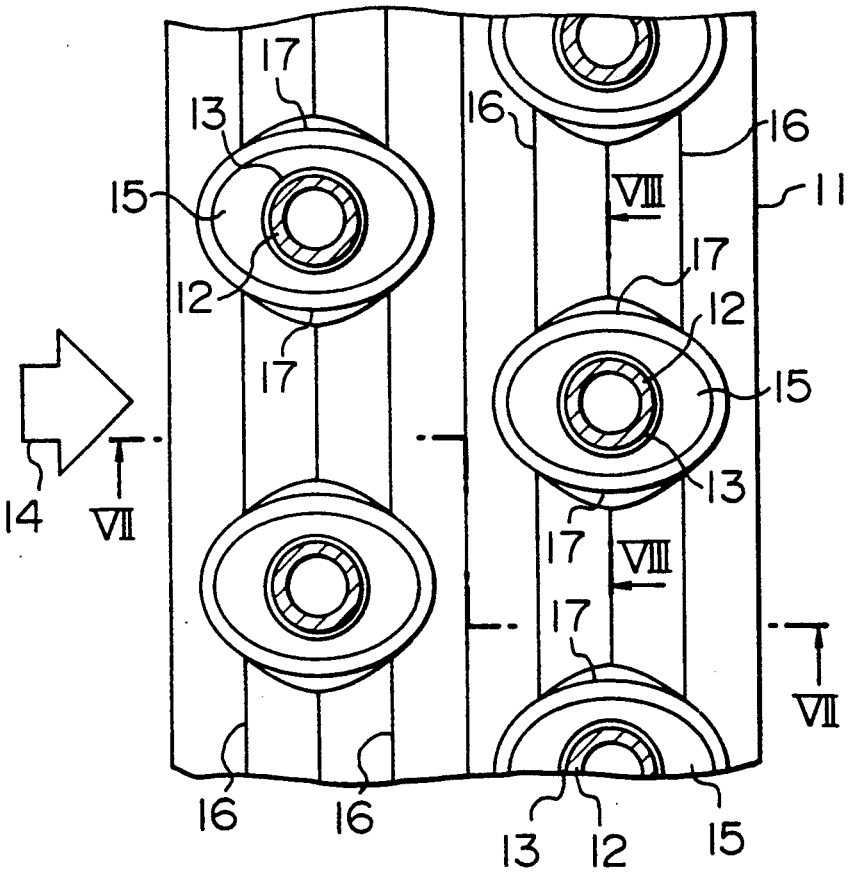
FIG. 6 is a front view of a fin of a fin-tube heat exchanger according to a first embodiment of the present invention.
Figure 7:
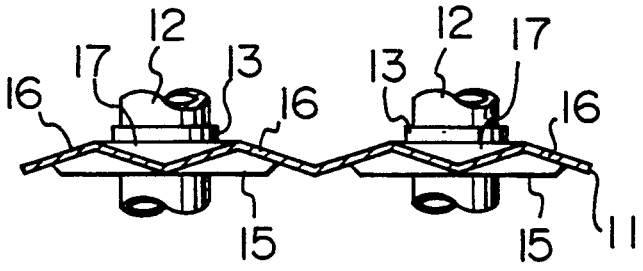
FIG. 7 is a sectional view taken along the line VII—VII in FIG. 6.
Figure 8:
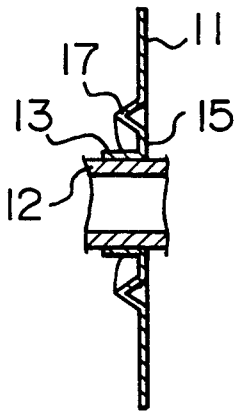
FIG. 8 is a sectional view taken along the line VIII—VIII in FIG. 6.

Fin-tube heat exchangers according to embodiments of the present invention are described below with reference to the drawings FIGS. 6 to 8 show a fin portion of a fin-tube heat exchanger in accordance with a first embodiment of the present invention. In the drawings, reference numeral 11 denotes a fin; reference numeral 12, tubes; reference numeral 13, fin collars; reference numeral 14, an air current; and reference numeral 15, seats each having an elliptic form which decreases the ventilation resistance and which has a short axis extending in the longitudinal direction of the fin 11. Seat-side ridge portions 17 are formed on the short-axis sides of each of the seats 15 along the outer periphery thereof. Two fin-side angular portions 16 each having a ridge that extends longitudinally linearly are formed in each line of the fin collars 13 so as to have substantially the same height as that of the highest portion of each of the seat-side ridge portions 17 which are formed at both sides of the short axis of each of the seats 15. The highest portion of each of the seat-side ridge portions 17 is formed between the tops of the two fin-side ridge portions 16.

In the above-described configuration, the turbulence promoting effect of the fin-side angular portions 16 improves the heat transfer efficiency, and the seat-side angular portions 17 cause the air current 14 to be controlled by the wake in the fin collars 13 so as to decrease the stagnation region, thereby increasing the heat transfer effective area and improving the heat transfer efficiency.

Figure 9:
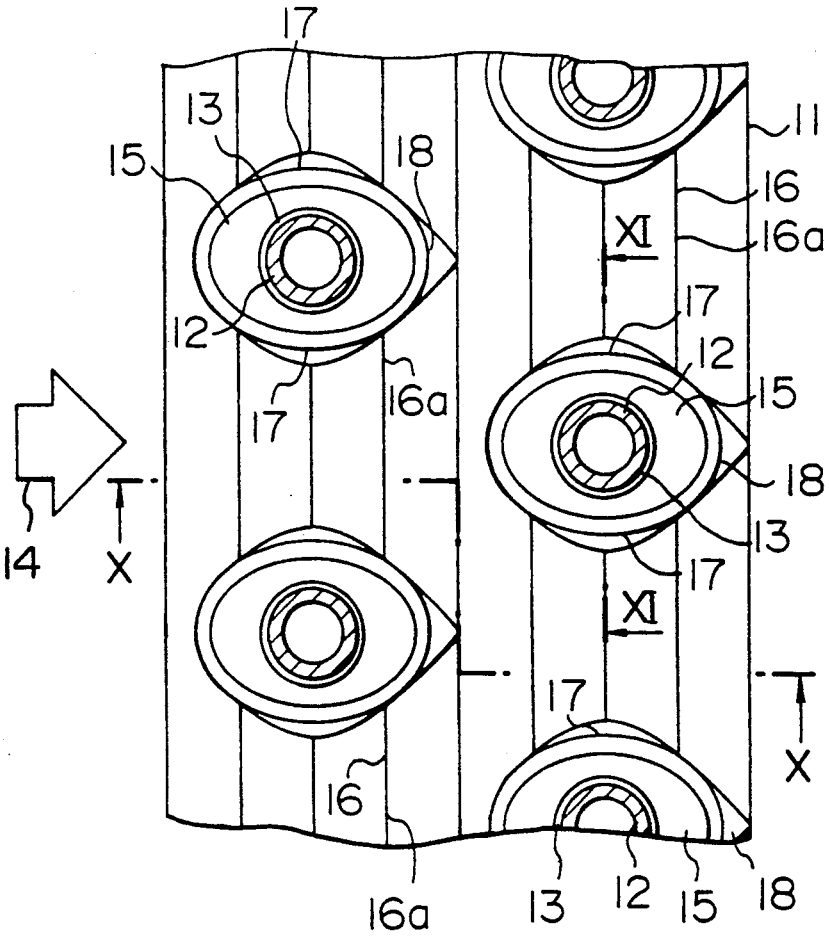
FIG. 9 is a front view of a fin of a fin-tube heat exchanger according to a second embodiment of the present invention.
Figure 10:
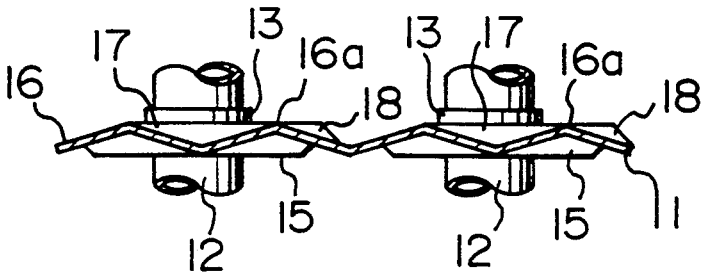
FIG. 10 is a sectional view taken along the line X—X in FIG. 9.
Figure 11:
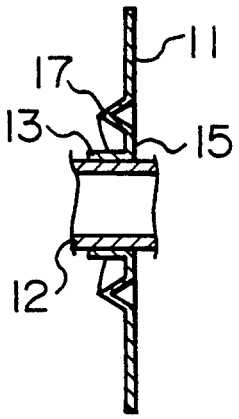
FIG. 11 is a sectional view taken along the line XI—XI in FIG. 9.

FIGS. 9 to 11 show a fin portion of a fin-tube heat exchanger in accordance with a second embodiment of the present invention. In the drawings, the same portions as those of the first embodiment are denoted by the same reference numerals and are not described below. In this embodiment, seat-side leeward ridge portions 18 each having the same height as that of the highest portion of each of the seat-side ridge portions 17 are respectively formed on the leeward sides of the fin-side ridge portions 16 so as to extend from the seat-side ridge portions 17 respectively formed between the tops of the fin-side ridge portions 16.

In this embodiment, the turbulence promoting effect of the fin-side ridge portions 16 improves the heat transfer efficiency, and the seat-side leeward ridge portions 18 respectively formed so as to extend from the highest portions of the seat-side ridge portions 17 cause the air flow 14 to be further controlled by the wake in the fin collars 13 so as to decrease the dead water region, thereby further increasing the heat transfer effective area and improving the heat transfer efficiency, as compared with the first embodiment.

Figure 12:
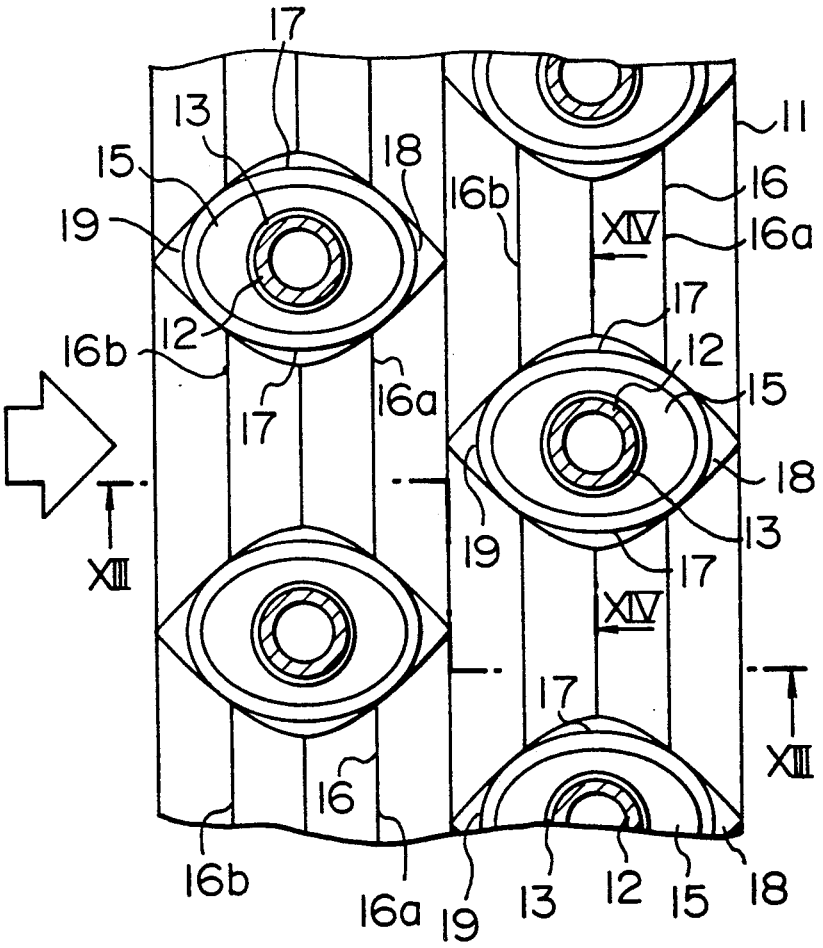
FIG. 12 is a front view of a fin of a fin-tube heat exchanger according to a third embodiment of the present invention.
Figure 13:
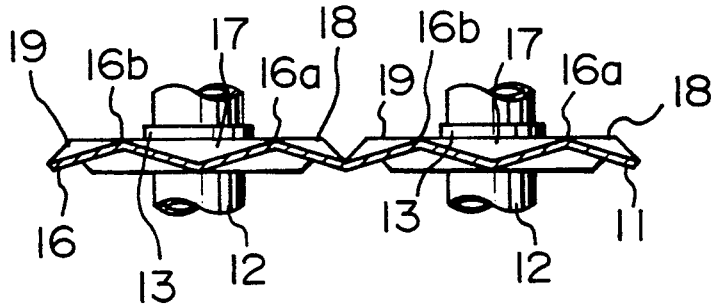
FIG. 13 is a sectional view taken along the line XIII—XIII in FIG. 12.
Figure 14:
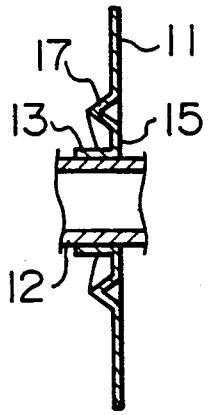
FIG. 14 is a sectional view taken along the line XIV—XIV in FIG. 12.

FIGS. 12 to 14 show a fin portion of a fin-tube heat exchanger in accordance with a third embodiment of the present invention. In the drawings, the same portions as those in the first and second embodiments are denoted by the same reference numerals and are not described below. In this embodiment, adding to the highest portion of the seat-side ridge portion 17 and the seat-side leeward ridge portion 18, seat-side windward ridge portions 19 each having the same height as that of the highest portion of each of the seat-side ridge portions 17 are respectively formed so as to extend from the windward tops **16*b* of the fin-side ridge portions 16 to the windward sides of the fin-side ridge portions 16. The whole outer peripheries of the seats 15 are respectively surrounded by the highest portions of the seat-side ridge portions 17, the seat-side leeward ridge portions 18 and the seat-side windward ridge portions 19**.

In the third embodiment, the heat transfer efficiency is improved by the turbulence promoting effect of the fin-side ridge portions 16, and vortexes are generated in the air current 14 by the highest portions of the seat-side ridge portions 17, the seat-side leeward ridge portions 18 and the seat-side windward ridge portions 19, which have concentric ridge-lines, thereby promoting heat transfer in the portions near the fin collars 13.

In any one of the first, second and third embodiments, the circular farm of each of the seats 15 yields smooth flow of air current 14, and suppresses any increase in the ventilation resistance.

As described above, in the fin-tube heat exchanger of the present invention, the turbulence promoting effect of the fin-side ridge portions, each having a longitudinally linearly extending ridge improves the heat transfer efficiency, and the seat-side ridge portions formed along the outer periphery of each of the seats between the two fin-side ridge portions cause the air flow to be controlled by the wake in the tubes so as to decrease the stagnation region, thereby increasing the heat transfer effective area and improving the heat transfer efficiency. In addition, since the ridge portions, each having the same height as that of the highest portion of each of the seat-side angular portions, are respectively formed on the leeward sides of the fin-side ridge portions, the heat transfer efficiency can be further improved. Further, since the seat-side ridge portions, each having substantially the same height as that of the highest portion of each of the fin-side ridge portions, are formed along the outer periphery of each of the seats, vortexes are generated. As a result heat transfer in the portions near the tubes is accelerated. The fin-tube heat exchanger thus has a high heat transfer efficiency and can be continuously operated for heating for a long time even if the fin-tube heat exchanger is used outdoors for a heat-pump air conditioner.

What is claimed is:

1. A plate fin heat exchanger comprising a plurality of plate-like fins disposed in parallel at predetermined intervals and a group of tubes upon which said fins are mounted, each said fin comprising:

a plurality of rows of holes for receiving said tubes disposed in spaced relation along a first direction, each hole being defined by a collar, each collar being surrounded by a substantially planar seat, all the seats lying substantially in a common plane and being shaped so as to define a long axis parallel to said first direction and a short axis, each seat being surrounded by a first ridge portion protruding from said common plane in a direction parallel to said tubes, and longitudinal ridges extending transverse to said first direction and having a height substantially the same as the highest protrusion of said ridge portions relative to said common plane.

2. A heat exchanger according to claim 1, wherein the highest protrusion of each of said ridge portions is formed between tops of two of said longitudinal ridges.

3. A heat exchanger according to claim 1, wherein the highest protrusion of each of said first ridge portions is formed between two tops of said longitudinal ridges, and second ridge portions, each having the same height as that of the highest protrusion of each of said first ridge portions, are formed on sides of said longitudinal ridges that are leeward relative to said first direction so as to extend from the tops of the longitudinal ridges to portions thereof leeward relative to said first direction.

4. A heat exchanger according to claim 1, wherein said ridge portions are formed over the whole periphery of each of said seats so as to have substantially the same height as that of the highest protrusion of each of said longitudinal ridges.

* * * * *